US005690586A

United States Patent [19]

Wilhelm

[11] Patent Number: 5,690,586

[45] Date of Patent: Nov. 25, 1997

[54] THERMAL HOT OR COLD HAND EXERCISER

[75] Inventor: Raymond P. Wilhelm, San Francisco, Calif.

[73] Assignee: Cold Ice Corporation, Oakland, Calif.

[21] Appl. No.: 674,139

[22] Filed: Jul. 1, 1996

[51] Int. Cl.[6] ..... A63B 23/16

[52] U.S. Cl. ..... 482/49; 422/44; 422/105

[58] Field of Search ..... 422/44, 49, 121, 422/105

[56] References Cited

U.S. PATENT DOCUMENTS 4,592,358 6/1986 Westplate ..... 482/105

4,929,211 5/1990 Resnick et al. ..... 482/49

4,967,573 11/1990 Wilhelm .

5,190,504 3/1993 Scatterday ..... 482/49

*Primary Examiner*—Lynne A. Reichard

*Attorney, Agent, or Firm*—Thomas R. Lampe

[57] ABSTRACT

Exercise apparatus for holding in the hand of an individual and for imparting heat or cold to the hand during manipulation of the exercise apparatus by the individual includes a flexible outer container defining an interior and a gel mixture located in the interior for retaining heat or cold applied to the exercise apparatus prior to placement of the exercise apparatus in the hand, the gel mixture including water, a gelling agent, and a freeze suppressant.

9 Claims, 1 Drawing Sheet

THERMAL HOT OR COLD HAND EXERCISER

TECHNICAL FIELD

This invention relates to exercise apparatus for holding in the hand of an individual and for imparting heat or cold to the hand during manipulation of the exercise apparatus by the individual.

BACKGROUND ART

It is known to provide heat and cold therapy packs which are employed by individuals to heat or cool parts of their bodies. For example, my U.S. Pat. No. 4,967,573, issued Nov. 6, 1990, discloses a two-compartment thermal pack for applying cold to a body part or other object upon mixing of the contents of the compartments. Thermal packs are also known which are utilized to apply heat. The devices known as hot water bottles typically comprise flexible containers containing heated water or other liquid or liquid-like material to impart heat to the user. Other systems are known wherein exothermic reactions take place within an outer container to generate heat. Some systems are capable of reuse while others are not. My U.S. Pat. No. 4,967,573, may be referred to for a general summary of the state of the prior art in this field.

It is well known to employ resilient balls and other objects as hand exercisers. Gel filled containers can also be suitably employed for such purpose, having the additional advantage that the gel can retain and impart heat or cold to the user's hand over a longer period of time than say, for example, resilient balls comprised solely of foam rubber or the like.

Latex provides a highly desirable outer wrap for exercise balls or similar objects employed as hand exercisers because of the physical characteristics of latex, including memory, flexibility, softness and impermeability. However, latex can and does dry out and crack over a period of time, rendering the hand exercise device useless. Also, it is highly desirable to have a hand exerciser capable of imparting heat or cold to the user which remains soft and pliable over a wide temperature range. Many prior art arrangements do not have this capability and do not readily lend themselves to both microwaving or freezing to selectively heat or cool the gel. Another deficiency of gel filled hand exercisers is that they can produce undesirable odors, particularly at higher temperature ranges.

DISCLOSURE OF INVENTION

The exercise apparatus of the present invention remedies the above-described problems commonly found in the prior art. The gel mixture employed in the exercise apparatus is of a specific character which operates to extend the life of a latex wrapper employed in the exercise apparatus and cooperates therewith to provide improved operation. More particularly, the gel mixture includes a component, propylene glycol, which provides an excellent moist and oily substructure that keeps the latex from drying out and cracking. This serves to increase the life of the latex wrapper considerably.

Propylene glycol also improves the function and operation of the exercise apparatus in another way by lowering the freezing point and raising the boiling point of the gel mixture. The propylene glycol acts as a freeze suppressant to enable the exercise apparatus to be frozen and the gel mixture to still remain soft and flexible.

The gel mixture also includes the additive lemon oil which acts as a lubricating release agent so that the gel does not unduly adhere to the inner walls of the latex wrapper and provides a homogeneous feel. This additive also scents the overall structure of the exercise apparatus. Latex has a natural smell that some people find offensive. Synthetic gel structures can have a sour smell. These smells are amplified when the components are heated in a microwave. The addition of lemon oil neutralizes these offensive odors and provides a light, fresh lemon scent.

The exercise apparatus of the present invention is for holding in the hand of an individual and for imparting heat or cold to the hand during manipulation of the exercise apparatus by the individual.

The apparatus includes a flexible outer container defining an interior.

A gel mixture is located in the interior of the flexible outer container for retaining heat or cold applied to the exercise apparatus prior to placement of the exercise apparatus in the hand. The gel mixture includes water comprising from about 50% to about 70% by weight of the gel mixture, a gelling agent in the form of polyacrylate comprising about 8% to about 15% by weight of the gel mixture, propylene glycol comprising from about 9% to about 18% by weight of the gel mixture, and lemon oil comprising from about 0.025% to about 0.10% by weight of the gel mixture.

The latex wrapper comprises multiple latex plies, one of the plies being in engagement with the gel mixture.

Other features, advantages, and objects of the present invention will become apparent with reference to the following description and accompanying drawings.

BEST MODE FOR CARRYING OUT THE INVENTION

Figure 1:
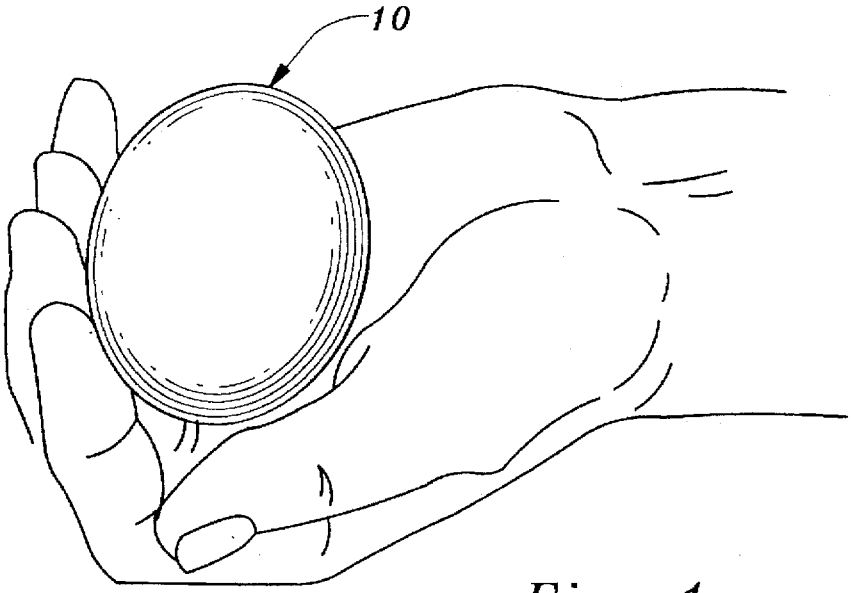
FIG. 1 is a perspective view illustrating exercise apparatus constructed in accordance with the teachings of the present invention in the hand of an individual.
Figure 2:
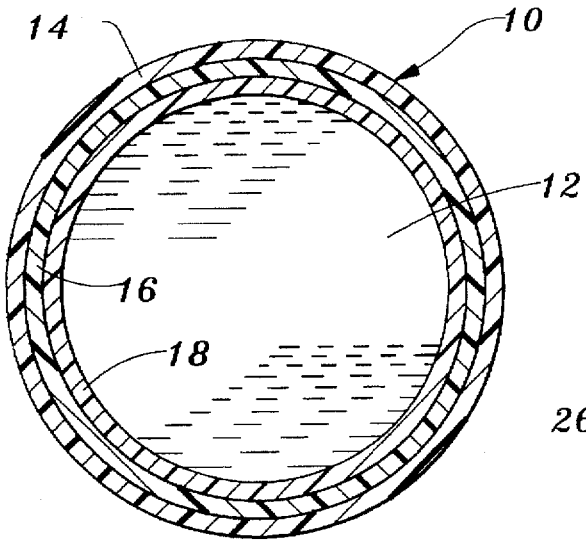
FIG. 2 is a cross-sectional view of the apparatus shown in FIG. 2.

Referring now to FIGS. 1 and 2, exercise apparatus constructed in accordance with the teachings of the present invention includes a flexible outer container 10 defining an interior 12. When practicing the teachings of the present invention it is preferred that the flexible outer container comprise at least three plies or layers of latex, preferably 100% natural helium grade latex, and preferably unbonded. In FIG. 2 three latex layers 14, 16, 18 are shown; however, other numbers of layers may be provided.

Innermost latex layer 16 is in engagement with a gel mixture located in the interior of the flexible outer container. The gel mixture is for the purpose of retaining heat or cold applied to the exercise apparatus prior to placement of the exercise apparatus in the user's hand. The gel mixture is of a precise character rendering the gel particularly useful in the context of a hand exerciser.

The finished gel viscosity is very important to the invention. The gel must have a viscosity of at least about 100,000 C.P.U. as measured by the brookfield method. If a lower viscosity gel structure is employed the resistance factor is lowered and one gets the feel of a water balloon offering little or no resistance when squeezed. The gel can be classified as a semi-solid material that is dry to the touch and will bounce when dropped.

Resistance or the amount of pressure required to deform the hand exerciser is of direct relationship to internal gel viscosity. Lower gel viscosity results in lower resistance. Without resistance the invention is useless as a hand exerciser.

The gel mixture includes a gelling agent in the form of polyacrylate comprising from about 8% to about 15% by weight of the gel mixture. A suitable commercially available polyacrylate is polyacrylate in powder form made available by Stuckhausen Inc. The gel mixture also incorporates fresh water constituting from about 50% to about 70% of the gel mixture by weight.

An important ingredient of the gel mixture is propylene glycol which constitutes from about 9% to about 18% by weight of the gel mixture. Finally, the gel mixture formulation includes lemon oil constituting from about 0.025% to about 0.10% by weight of the gel mixture.

As indicated above, the water of the gel mixture combined with the oil-like propylene glycol provides an excellent moist and oily substructure that keeps the latex wrapper from drying out and cracking. The possibility of leaking of the gel mixture is also greatly reduced by the ply in ply or layer in layer structure of the latex flexible outer container.

Propylene glycol has a freezing point of minus 76 degrees Fahrenheit and a boiling point of 370 degrees Fahrenheit. When the propylene glycol is added to the polyacrylate and water components of the gel mixture, the freezing point will lower and the boiling point will be higher; of course the degree of change will depend upon the amount of propylene glycol incorporated in the gel structure.

Apparatus constructed as described above enables microwaving to produce high temperatures, i.e. temperatures exceeding 100 degrees Fahrenheit, in 60 seconds or less using standard home microwaving equipment. The gel mixture, which has a high viscosity at the ranges noted above, can readily remain warm for over 30 minutes. The same gel mixture, preconditioned in a freezer for a minimum of 2 hours at zero degrees Fahrenheit, will remain cold for over an hour as well. The gel mixture taken out of the freezer can reverse back to the heated form in less than 2 minutes in a standard microwave oven. This unique semi-solid, thermal retaining, pressure resisting, memory gel disposed in a double wall latex wrapper produces a product that is unique both with regard to function and form as compared to prior art therapeutic hot or cold hand exercisers.

As indicated above, the lemon oil component of the gel mixture is also quite important, not only as a smell masking agent but also due to the fact that it acts as a lubricating release agent so that the gel mixture does not substantially adhere to the inner wall or layer 16 of the outer container.

The precise shape of the exercise apparatus should be one that ergonomically fits the human hand, round or egg shapes being representative examples. It is desirable that the exercise apparatus not only remain soft and pliable over a wide range of temperatures but also have a uniform feel and texture. The above-described outer container and gel mixture are cooperable to attain these characteristics.

Figure 3:
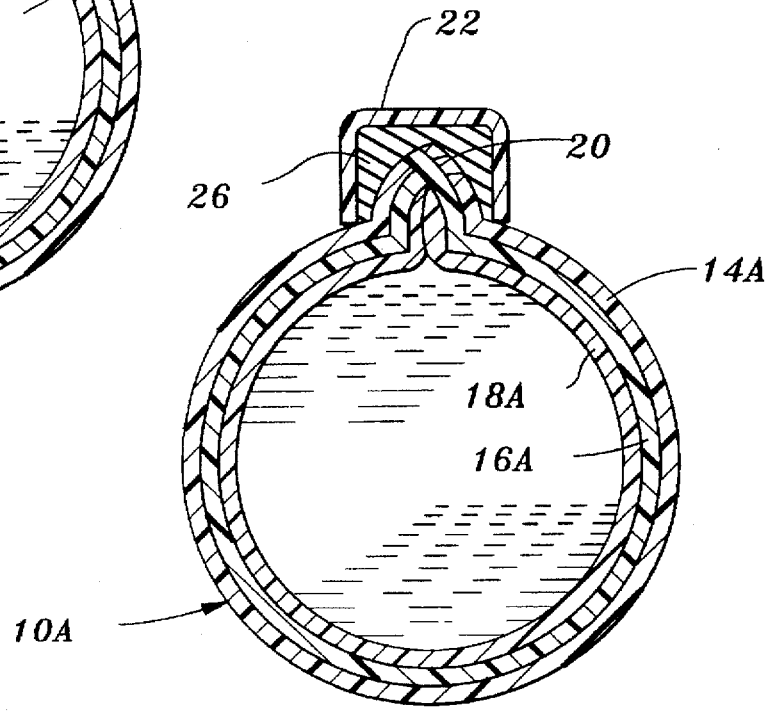
FIG. 3 is a cross-sectional view of an alternative form of the exercise apparatus.

FIG. 3 illustrates another form of the invention wherein the inner and outer latex layers or plies 14A, 16A of outer container 10A are of a generally balloon-like character having necks which are knotted together at 20 and covered by a cap 22 secured to the knot by an adhesive 26. Of course, still other structures may be employed which practice the teachings of the present invention and which are encompassed by the claims hereof.

I claim:

1. Exercise apparatus for holding in the hand of an individual and for imparting heat or cold to the hand during manipulation of the exercise apparatus by an individual, said apparatus comprising, in combination:

a flexible outer container defining an interior; and a gel mixture located in the interior of the flexible outer container for retaining heat or cold applied to the exercise apparatus prior to placement of the exercise apparatus in the hand, said gel mixture including water, a gelling agent, propylene glycol; and a scent producing agent.

2. The exercise apparatus according to claim 1 wherein said flexible outer container comprises a latex wrapper encompassing said gel mixture.

3. The exercise apparatus according to claim 2 wherein said latex wrapper comprises multiple latex plies, one of said plies being in engagement with said gel mixture.

4. The exercise apparatus according to claim 1 wherein said scent producing agent is lemon oil.

5. The exercise apparatus according to claim 1 wherein said gelling agent is polyacrylate and comprises from about 8% to about 15% by weight of said gel mixture.

6. The exercise apparatus according to claim 5 wherein said water comprises from about 50% to about 70% by weight of said gel mixture.

7. The exercise apparatus according to claim 6 wherein said propylene glycol comprises from about 9% to about 18% by weight of said gel mixture.

8. The exercise apparatus according to claim 7 wherein said gel mixture additionally comprises lemon oil, said lemon oil comprising from about 0.025% to about 0.10% by weight of said gel mixture.

9. Exercise apparatus for holding in the hand of an individual and for imparting heat or cold to the hand during manipulation of the exercise apparatus by an individual, said apparatus comprising, in combination:

a flexible outer container defining an interior; and a gel mixture located in the interior of the flexible outer container for retaining heat or cold applied to the exercise apparatus prior to placement of the exercise apparatus in the hand, said gel mixture including water, a gelling agent, propylene glycol and lemon oil, said gelling agent being polyacrylate and comprising from about 8% to about 15% by weight of said gel mixture, said water comprising from about 50% to about 70% by weight of said gel mixture, and said lemon oil comprising from about 0.025% to about 0.10% by weight of said gel mixture.

* * * * *